US005277034A

United States Patent [19]

Hojo et al.

[11] Patent Number: 5,277,034

[45] Date of Patent: Jan. 11, 1994

[54] AIR CONDITIONING SYSTEM

[75] Inventors: Toshiyuki Hojo, Shimizu; Kenji Tokusa, Shizuoka; Kensaku Oguni, Shimizu; Susumu Nakayama, Shizuoka, all of Japan

[73] Assignee: Hitachi, Ltd., Tokyo, Japan

[21] Appl. No.: 855,670

[22] Filed: Mar. 23, 1992

[30] Foreign Application Priority Data

Mar. 22, 1991 [JP] Japan ..... 3-058746

[51] Int. Cl.[5] ..... F25B 13/00

[52] U.S. Cl. ..... 62/160; 62/173; 62/176.5; 62/176.6; 62/223; 62/225; 165/3; 165/21; 165/26

[58] Field of Search ..... 62/90, 159, 160, 173, 62/176.5, 176.6, 225, 223; 165/3, 21, 30, 26

[56] References Cited

U.S. PATENT DOCUMENTS

| | | | |
|---|---|---|---|
| 3,421,339 | 1/1969 | Volk et al. | 62/173 X |
| 4,663,725 | 5/1987 | Truckenbrod et al. | 165/26 X |
| 4,745,767 | 5/1988 | Ohya et al. | 62/225 X |
| 4,938,032 | 7/1990 | Mudford | 62/160 |
| 5,065,588 | 11/1991 | Nakayama et al. | 62/160 |

FOREIGN PATENT DOCUMENTS

| | | |
|---|---|---|
| 81455 | 5/1984 | Japan . |
| 180253 | 10/1984 | Japan . |
| 82066 | 3/1990 | Japan . |

*Primary Examiner*—Harry B. Tanner

*Attorney, Agent, or Firm*—Antonelli, Terry, Stout & Kraus

[57] ABSTRACT

An air-conditioning system for a cooling operation and a heating operation comprises a first heat exchanger to which a high-pressure and high-temperature refrigerant which has not been substantially cooled and adiabatically expanded after being compressed is supplied to heat the inside of a room to be air-conditioned during both of the cooling operation and the heating operation, a second heat exchanger to which a low-pressure and low-temperature refrigerant which has been substantially cooled and adiabatically expanded after being compressed is supplied to cool the inside of the room during both of the cooling operation and heating operation, and an air flow generator for generating an air flow which passes the first heat exchanger and the second heat exchanger, wherein the second heat exchanger is arranged at an upstream side of the first heat exchanger in the air flow.

23 Claims, 6 Drawing Sheets

AIR CONDITIONING SYSTEM

BACKGROUND OF THE INVENTION AND RELATED ART STATEMENT

The present invention relates to an air-conditioning system in which a dehumidification operation can be achieved during a heating operation and a cooling operation.

In a prior-art air-conditioning system as disclosed in Japanese Patent Unexamined Publication No. 59-180253, a first heat exchanger, a second heat exchanger and a fan for generating air flow are arranged in a room to be air-conditioned. The first heat exchanger and the second heat exchanger are positioned in series in a direction of the air flow by the fan and are received by a unit. In a cooling operation of the prior-art air-conditioning system, a high-pressure and high-temperature refrigerant which has not been substantially cooled and adiabatically expanded after being compressed is supplied to the first heat exchanger and a low-pressure and low-temperature refrigerant which has been substantially cooled and adiabatically expanded after being compressed is supplied to the second heat exchanger. In a heating operation of the prior-art air-conditioning system, the low-pressure and low-temperature refrigerant which has been substantially cooled and adiabatically expanded after being compressed is supplied to the first heat exchanger and the high-pressure and high-temperature refrigerant which has not been substantially cooled and adiabatically expanded after being compressed is supplied to the second heat exchanger.

OBJECT AND SUMMARY OF THE INVENTION

An object of the present invention is to provide an air-conditioning system in which a change between a cooling operation and a heating operation can be carried out instantly and a dehumidification operation can always be carried out effectively.

According to the present invention, an air-conditioning system for a cooling operation and a heating operation comprises, a first heat exchanger to which a high-pressure and high-temperature refrigerant which has not been substantially cooled and adiabatically expanded after being compressed is supplied to heat the inside of a room to be air-conditioned during both of the cooling operation and the heating operation, a second heat exchanger to which a low-pressure and low-temperature refrigerant which has been substantially cooled and adiabatically expanded after being compressed is supplied to cool the inside of the room during both of the cooling operation and the heating operation, and a fan for generating an air flow which passes the first heat exchanger and the second heat exchanger, wherein the second heat exchanger is arranged at an upstream side of the first heat exchanger in the air flow.

In the air-conditioning system according to the present invention, since the air flow in the room to be air-conditioned is cooled for dehumidification by the second heat exchanger and subsequently is heated by the first heat exchanger, the air flow can be cooled effectively to a low temperature for the dehumidification by the second heat exchanger during both of the cooling operation and the heating operation. And, since the high-pressure and high-temperature refrigerant is supplied to the first heat exchanger during both of the cooling operation and the heating operation and the low-pressure and low-temperature refrigerant is supplied to the second heat exchanger during both of the cooling operation and the heating operation, refrigerant conditions in the first and second heat exchangers does not vary from the low-pressure and low-temperature refrigerant to the high-pressure and high-temperature refrigerant and from the high-pressure and high-temperature refrigerant to the low-pressure and low-temperature refrigerant when a change between the cooling operation and the heating operation is carried out, so that the change between the cooling operation and the heating operation can be carried out instantly.

DETAILED DESCRIPTION OF PREFERRED EMBODIMENTS

Figure 1:
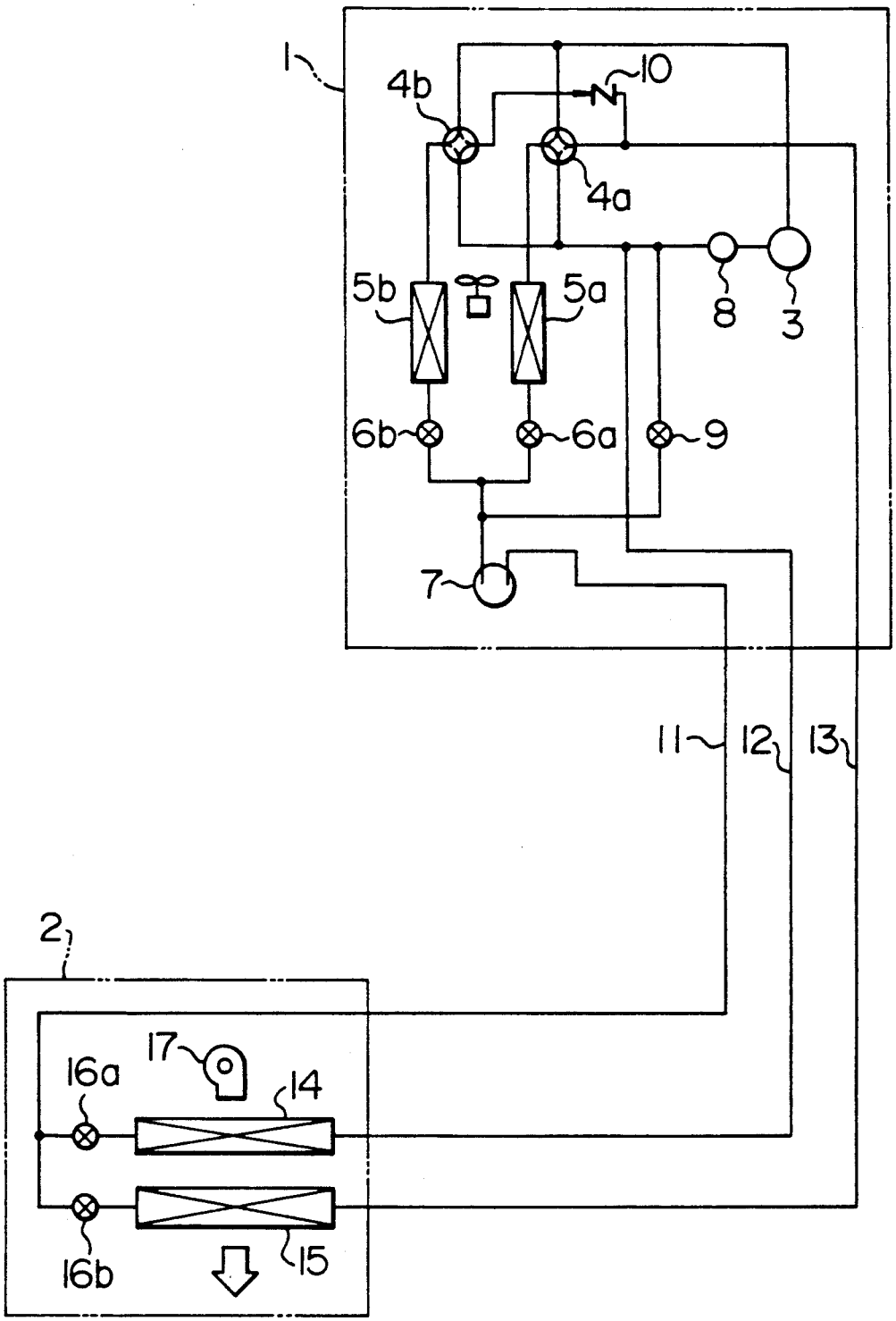
FIG. 1 is a schematic view showing an embodiment of an air-conditioning system according to the present invention.

As shown in FIG. 1, an outdoor unit 1 includes a compressor 3, four port connection valves **4*a* and 4*b*, outdoor heat exchangers 5*a* and 5*b*, outdoor adiabatic expansion valves 6*a* and 6*b* each of which can control a refrigerant flow rate therethrough, a liquid refrigerant receiver 7, a refrigerant flow rate accumulator 8, a bypass adiabatic expansion valve 9 and a one-way valve 10 which allows the refrigerant to flow from the four port connection valve 4*b* to a high-pressure gas refrigerant pipe 13 and prevents the refrigerant from flowing from the high-pressure gas refrigerant pipe 13 to the four port connection valve 4*b*. An indoor unit 2 includes an air flow generating device 17 of rotating fan type for generating an air flow of a fixed air flow direction shown by an arrow mark, a second indoor heat exchanger 14 arranged at an upstream side of the air flow direction, a first indoor heat exchanger 15 arranged at a downstream side of the air flow direction and indoor adiabatic expansion valves 16*a* and 16*b* which can control refrigerant flow rates through the second indoor heat exchanger 14 and the first indoor heat exchanger 15 respectively. In the indoor adiabatic expansion valve 16***a*, the refrigerant supplied to the second indoor heat exchanger 14 after being cooled by the outdoor heat exchangers 5*a* and/or 5*b* and/or by the first indoor heat exchanger 15 is expanded adiabatically. The outdoor unit 1 and the indoor unit 2 ar connected fluidly to each other as follows. An end of the liquid refrigerant receiver 7 is connected to the second indoor heat exchanger 14 and the first indoor heat exchanger 15 through a liquid refrigerant pipe 11 and the indoor adiabatic expansion valves 16*a* and 16*b*. The second indoor heat exchanger 14 is connected to an inlet port of the compressor 3 through a low-pressure gas refrigerant pipe 12 so that the refrigerant after the adiabatic expansion returns to the compressor 3. The first indoor heat exchanger 15 is connected to the four port connection valves 4*a* and 4*b* through the high-pressure gas refrigerant pipe 13 so that a high-pressure compressed gas refrigerant is supplied to the first indoor heat exchanger 15 from the compressor 3.

Each of the four port connection valves 4*a* and 4*b* can be set at a first position in which the high-pressure compressed gas refrigerant is allowed to flow from the compressor 3 to the first indoor heat exchanger 15 through the high-pressure gas refrigerant pipe 13 and is prevented from flowing from the compressor 3 to the second indoor heat exchanger 14 through the outdoor heat exchangers 5*a* and/or 5*b* and at a second position in which the high-pressure compressed gas refrigerant is prevented from flowing from the compressor 3 to the first indoor heat exchanger 15 through the high-pressure gas refrigerant pipe 13 and is allowed to flow from the compressor 3 to the second indoor heat exchanger 14 through the outdoor heat exchangers 5*a* and/or 5*b*. When a dehumidification operation is carried out during a heating operation or a cooling operation, one of the four port connection valves 4*a* and 4*b* is set at the first position and another one of the four port connection valves 4*a* and 4*b* is set at the second position.

When a temperature in a room to be air-conditioned is adjusted at a predetermined degree by the cooling operation or the heating operation during the dehumidification operation, a part of the high-pressure compressed gas refrigerant from the compressor 3 flows into the high-pressure gas refrigerant pipe 13 through the four port connection valve 4*a*, and the other part of the high-pressure compressed gas refrigerant from the compressor 3 flows into the liquid refrigerant pipe 11 through the outdoor adiabatic expansion valves 6*b* whose opening degree is not significantly decreased so that the refrigerant flow rate therethrough is controlled without the adiabatic expansion therein and through the liquid refrigerant receiver 7 after the high-pressure compressed gas refrigerant is cooled to be condensed at the outdoor outdoor adiabatic expansion valve 6*b* and the liquid refrigerant receiver 7 is supplied to the inlet port of the compressor 3 through the bypass adiabatic expansion valve 9.

In the indoor unit 2, the liquid refrigerant from the liquid refrigerant pipe 11 is adiabatically expanded at the indoor adiabatic expansion valve 16*a* and the gas refrigerant after the adiabatic expansion is supplied to the second indoor heat exchanger 14. The gas refrigerant cools the air flow generated by the air flow generating device 17 through a heat-exchange in the second indoor heat exchanger 14 so that a water component of the air in the room to be air-conditioned is changed to dew and the air is dehumidified. Subsequently, the gas refrigerant flows from the second indoor heat exchanger 14 into the inlet port of the compressor 3 through the low-pressure gas refrigerant pipe 12. The high-pressure and high-temperature gas refrigerant supplied into the first indoor heat exchanger 15 from an outlet port of the compressor 3 through the high-pressure gas refrigerant pipe 13 heats the air which has been passed the second indoor heat exchanger 14 and has been cooled and dehumidified thereby, so that the high-pressure and high-temperature gas refrigerant is cooled and condensed to be changed to a high-pressure and low-temperature (liquid) refrigerant. The high-pressure and low-temperature refrigerant from the first indoor heat exchanger 15 flows into the second indoor heat exchanger 14 through the liquid refrigerant pipe 11 and the indoor adiabatic expansion valves 16*a* and 16*b*. A flow rate of the high-pressure and low-temperature refrigerant from the first indoor heat exchanger 15 is controlled by the indoor adiabatic expansion valve 16*b* and the high-pressure and low-temperature refrigerant expands adiabatically at the indoor adiabatic expansion valve 16*a* with the high-pressure and low-temperature refrigerant from the outdoor heat exchanger 5*a* or 5*b*. The low-pressure (gas) refrigerant flowing out from the second indoor heat exchanger 14 after cooling and dehumidifying the air in the room flows into the inlet port of the compressor 3 through the low-pressure gas refrigerant pipe 12 and the accumulator 8. During the dehumidification operation in both of the cooling and heating operations, in the indoor unit 2, the air is at first cooled and dehumidified at the second indoor heat exchanger 14 and subsequently the air from the second indoor heat exchanger 14 is heated at the first indoor heat exchanger 15. That is, the second indoor heat exchanger 14 operates as an evaporator and the first indoor heat exchanger 15 operates a condensor. In the indoor unit 2, a change between the cooling operation with the dehumidification operation and the heating operation with the dehumidification operation is achieved by changing an opening degree of the indoor adiabatic expansion valve 16*a* or 16*b* or the opening degrees of both of the indoor adiabatic expansion valves 16*a* and 16*b* and/or the opening degrees of the outdoor adiabatic expansion valves 6*a* and 6*b*, that is, by changing a relation among the opening degrees of the indoor adiabatic expansion valves 16*a* and 16*b* and the outdoor adiabatic expansion valves 6*a* and 6*b*.

In other words, the change between the cooling operation with the dehumidification operation and the heating operation with the dehumidification operation or a change of output energy of the indoor unit 2 in the cooling operation with the dehumidification operation and the heating operation with the dehumidification operation is achieved by changing a ratio of a heating energy from the first indoor heat exchanger 15 to a cooling energy from the second indoor heat exchanger 14 or by changing a ratio of a flow rate of refrigerant through the first indoor heat exchanger 15 to a flow rate of refrigerant through the second indoor heat exchanger 14. The outdoor adiabatic expansion valves 6*a* and 6*b* control the flow rate of refrigerant from the outdoor heat exchangers 5*a* and 5*b* to the second indoor heat exchanger 14, the indoor adiabatic expansion valve 16*b* controls the flow rate of refrigerant from the first indoor heat exchanger 15 to the second indoor heat exchanger 14, and the indoor adiabatic expansion valve 16*a* controls the flow rate of refrigerant from the first indoor heat exchanger 15 and the outdoor heat exchangers 5a and 5b to the second indoor heat exchanger 14.

In the cooling operation without the heating operation after the dehumidification, the four port connection valves 4a and 4b allow a flow of the high-pressure and high-temperature refrigerant from the outlet port of the compressor 3 to the outdoor heat exchangers 5a and 5b and the indoor adiabatic expansion valve 16b is closed so that the high-pressure and high-temperature (gas) refrigerant is cooled and condensed by the outdoor heat exchangers 5a and 5b to be changed to the high-pressure and low-temperature (liquid) refrigerant, the high-pressure and low-temperature (liquid) refrigerant after passing the outdoor adiabatic expansion valves 6a and 6b, the liquid receiver 7 and the liquid refrigerant pipe 11 expands adiabatically at the indoor adiabatic expansion valve 16a to be changed to the low-pressure and low-temperature (gas) refrigerant. The low-pressure and low-temperature (gas) refrigerant cools and dehumidifie the air flow at the second indoor heat exchanger 14. Subsequently, the low-pressure and low-temperature (gas) refrigerant flows into the inlet port of the compressor 3 through the low-pressure gas refrigerant pipe 12 and the accumulator 8. On the other hand, since the indoor adiabatic expansion valve 16b is closed and the four port connection valves 4a and 4b allow a refrigerant flow from the high-pressure gas refrigerant pipe 13 to the low-pressure gas refrigerant pipe 12 so that a pressure in the first indoor heat exchanger 15 is kept at a low pressure substantially equal to a pressure at the inlet port of the compressor 3, the first indoor heat exchanger 15 does not heat the air and only the cooling operation is achieved.

In another way of the cooling operation without the heating operation after the dehumidification, the four port connection valves 4a and 4b allow the flow of the high-pressure and high-temperature refrigerant from the outlet port of the compressor 3 to the outdoor heat exchangers 5a and 5b and allow the refrigerant flow from the high-pressure gas refrigerant pipe 13 to the low-pressure gas refrigerant pipe 12 and the indoor adiabatic expansion valves 16a and 16b are opened so that the high-pressure and high-temperature (gas) refrigerant is cooled and condensed by the outdoor heat exchangers 5a and 5b to be changed to the high-pressure and low-temperature (liquid) refrigerant and the high-pressure and low-temperature (liquid) refrigerant after passing the outdoor adiabatic expansion valves 6a and 6b, the liquid receiver 7 and the liquid refrigerant pipe 11 expands adiabatically at the indoor adiabatic expansion valves 16a and 16b to be changed to the low-pressure and low-temperature (gas) refrigerant. The low-pressure and low-temperature (gas) refrigerant cools and dehumidifies the air flow at the first and second indoor heat exchangers 14 and 15. Subsequently, the low-pressure and low-temperature (gas) refrigerant flows into the inlet port of the compressor 3 through the low-pressure gas refrigerant pipe 12 and the high-pressure gas refrigerant pipe 13. Therefore, the first indoor heat exchanger 15 does not heat the air and only the cooling operation is achieved.

In the heating operation without the dehumidification, the four port connection valves 4a and 4b allow the flow of the high-pressure and high-temperature refrigerant from the outlet port of the compressor 3 to the high-pressure gas refrigerant pipe 13 and allow the refrigerant flow from the outdoor heat exchangers 5a and 5b to the inlet port of the compressor 3, and the indoor adiabatic expansion valve 16a is closed, so that the high-pressure and high-temperature refrigerant flows into the first indoor heat exchanger 15 from the high-pressure gas refrigerant pipe 13 to heat the air flow and to be cooled and condensed. The flow rate of the refrigerant passing through the first indoor heat exchanger 15 is controlled by the indoor adiabatic expansion valve 16b. The condensed liquid refrigerant flows from the first indoor heat exchanger 15 into the outdoor adiabatic expansion valves 6a and 6b through the liquid refrigerant pipe 11 and the liquid refrigerant receiver 7 and expands adiabatically at the outdoor adiabatic expansion valves 6a and 6b. The low-pressure refrigerant from the outdoor adiabatic expansion valves 6a and 6b is heated and evaporated by the outdoor heat exchangers 5a and 5b. The evaporated refrigerant from the outdoor heat exchangers 5a and 5b flows into the inlet port of the compressor 3 through the four port connection valves 4a and 4b and the accumulator 8. Since the indoor adiabatic expansion valve 16a is closed and the second indoor heat exchanger 14 is connected to the low-pressure gas refrigerant pipe 12, the refrigerant does not flow through the second indoor heat exchanger 14. Therefore, the second indoor heat exchanger 14 does not cool the air and only the heating operation without the dehumidification is achieved.

Figure 2:
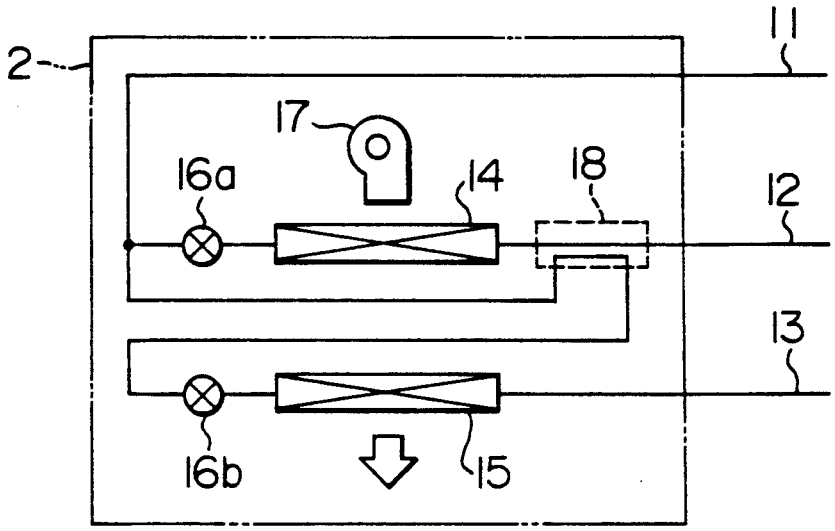
FIG. 2 is a schematic view showing an embodiment of an air-conditioning indoor unit according to the present invention.

In embodiments shown in FIGS. 2–7, the compressed high-pressure and high-temperature refrigerant without being substantially cooled and adiabatically expanded is supplied to the first heat exchanger 15 and the low pressure and low temperature refrigerant with being substantially cooled and subsequently adiabatically expanded after compressed is supplied to the second heat exchanger 14. As shown in FIG. 2, the refrigerant flowing out from the first indoor heat exchanger 15 after being cooled therein may be further cooled by a third heat exchanger 18 through which the refrigerant flowing out from the second indoor heat exchanger 14 after the adiabatic expansion flows. In this modification, if the refrigerant is not sufficiently cooled and condensed by the first indoor heat exchanger 15, the refrigerant flowing from the first indoor heat exchanger 15 into the second indoor heat exchanger 14 is sufficiently cooled and condensed by the third heat exchanger 18.

Figure 3:
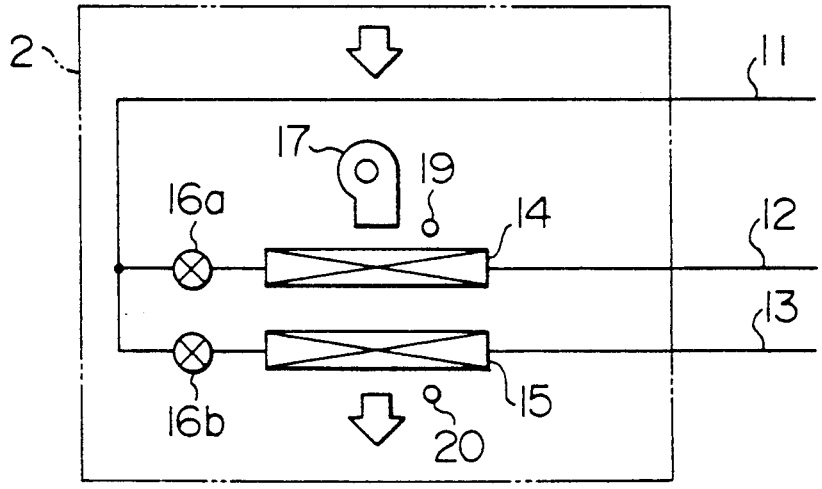
FIG. 3 is a schematic view showing an arrangement of temperature measuring devices according to the present invention.

As shown in FIG. 3, it is preferable that a temperature sensor 19 measures a temperature of the air flow generated by the air flow generating device 17 in the indoor unit 2 at an upstream side of the second indoor heat exchanger 14 in the air flow, a temperature sensor 20 measures a temperature of the air flow at a downstream side of the first indoor heat exchanger 15 in the air flow and the opening degrees of the outdoor adiabatic expansion valves 6a and/or 6b and/or the indoor adiabatic expansion valves 16a and/or 16b are controlled in accordance with the measured temperatures. The temperature measured by the temperature sensor 19 corresponds substantially to a temperature of the air in the room to be air-conditioned and the temperature measured by the temperature sensor 20 corresponds substantially to a heating or cooling energy supplied to the air in the room to be air-conditioned. A desired temperature of the air flow at the downstream side of the first indoor heat exchanger 15 is determined on the basis of a difference between a predetermined temperature (a desired temperature of the air in the room to be air-conditioned) and the temperature measured by the temperature sensor 19, and the opening degrees of the the indoor adiabatic expansion valves 16a and/or 16b are controlled to change the temperature measured by the temperature sensor 20 to the desired temperature. When the temperature measured by the temperature sensor 19 is lower than the predetermined temperature (the desired temperature of the air in the room to be air-conditioned), the temperature measured by the temperature sensor 20 should be higher than the predetermined temperature. When the temperature measured by the temperature sensor 19 is substantially equal to the predetermined temperature, the temperature measured by the temperature sensor 20 should be substantially equal to the predetermined temperature. When the temperature measured by the temperature sensor 19 is higher than the predetermined temperature, the temperature measured by the temperature sensor 20 should be lower than the predetermined temperature. In order to increase the temperature at the downstream side of the first indoor heat exchanger 15, the heating energy generated by the first indoor heat exchanger 15 is increased and/or the cooling energy generated by the second indoor heat exchanger 14 is decreased. In order to increase the heating energy generated by the first indoor heat exchanger 15, the opening degree of the indoor adiabatic expansion valve **16*b* is increased. In order to decrease the cooling energy generated by the second indoor heat exchanger 14, the opening degrees of the indoor adiabatic expansion valve 16*a* and/or the outdoor adiabatic expansion valves 6*a* and/or 6*b* are decreased. In order to decrease the temperature at the downstream side of the first indoor heat exchanger 15, the heating energy generated by the first indoor heat exchanger 15 is decreased and/or the cooling energy generated by the second indoor heat exchanger 14 is increased. In order to decrease the heating energy generated by the first indoor heat exchanger 15, the opening degree of the indoor adiabatic expansion valve 16*b* is decreased. In order to increase the cooling energy generated by the second indoor heat exchanger 14, the opening degrees of the indoor adiabatic expansion valve 16*a* and/or the outdoor adiabatic expansion valves 6*a* and/or 6*b* are increased. When the opening degree of the indoor adiabatic expansion valve 16*a* is excessively large as an adiabatic expansion orifice, the refrigerant after being pressurized and cooled does not expand adiabatically at the indoor adiabatic expansion valve 16*a* and the refrigerant of liquid condition is supplied to the second indoor heat exchanger 14. Therefore, the opening degree of the indoor adiabatic expansion valve 16*a*** should be appropriately limited.

Figure 4:
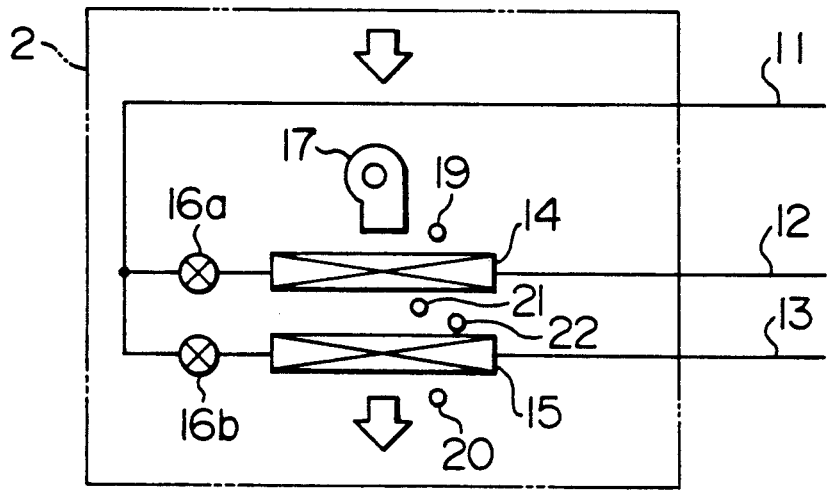
FIG. 4 is a schematic view showing another arrangement of temperature measuring devices according to the present invention.

As shown in FIG. 4, it is preferable that the temperature sensor 19 measures the temperature of the air flow generated by the air flow generating device 17 in the indoor unit 2 at the upstream side of the second indoor heat exchanger 14 in the air flow, the temperature sensor 20 measures the temperature of the air flow at the downstream side of the first indoor heat exchanger 15 in the air flow, a temperature sensor 21 measures a temperature of the air flow at the downstream side of the second indoor heat exchanger 14 in the air flow, a temperature sensor 22 measures a temperature of the air flow at the upstream side of the first indoor heat exchanger 15 and the opening degrees of the outdoor adiabatic expansion valves **6*a* and/or 6*b* and/or the indoor adiabatic expansion valves 16*a* and/or 16*b* are controlled in accordance with the measured temperatures. Alternatively, it is preferable that the temperature sensor 19 measures the temperature of the air flow generated by the air flow generating device 17 in the indoor unit 2 at the upstream side of the second indoor heat exchanger 14 in the air flow, the temperature sensor 20 measures the temperature of the air flow at the downstream side of the first indoor heat exchanger 15 in the air flow, a temperature sensor 23 measures a temperature of the air flow between the second indoor heat exchanger 14 and the first indoor heat exchanger 15 and the opening degrees of the outdoor adiabatic expansion valves 6*a* and/or 6*b* and/or the indoor adiabatic expansion valves 16*a* and/or 16*b*** are controlled in accordance with the measured temperatures.

Figure 5:
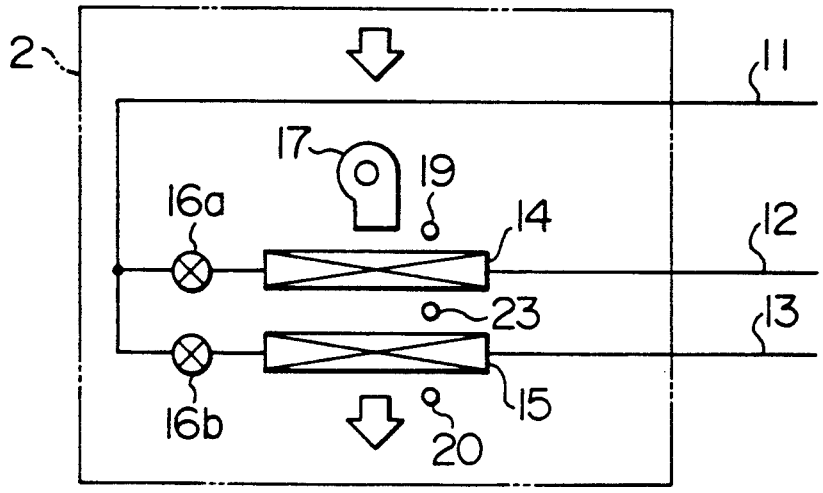
FIG. 5 is a schematic view showing another arrangement of temperature measuring devices according to the present invention.

In the embodiments shown in FIGS. 4 and 5, a control according to the measured temperature by the temperature sensors 19 and 20 is substantially equal to the control used in the embodiment shown in FIG. 3. The temperatures measured by the temperature sensors 21 and 22 are substantially equal to the temperature measured by the temperature sensor 23. It is ideal that the temperatures measured by the temperature sensors 21, 22 and 23 are kept slightly lower than the dew point of the air in the room to be air-conditioned. Since the temperatures measured by the temperature sensors 21, 22 and 23 are higher than a heat-exchange surface temperature of the second indoor heat exchanger 14, there is a possibility that the heat-exchange surface temperature of the second indoor heat exchanger 14 is not higher than 0° C. (the freezing point) even when the temperatures measured by the temperature sensors 21, 22 and 23 are higher than 0° C. and the temperatures measured by the temperature sensors 21, 22 and 23 are kept slightly lower than the dew point. Therefore, the temperature measured by the temperature sensors 21, 22 and 23 should be higher than 0° C. and substantially equal to the dew point. The outdoor adiabatic expansion valves **6*a* and/or 6*b* and/or the indoor adiabatic expansion valve 16*a* are controlled to keep the temperature between the second indoor heat exchanger 14 and the first indoor heat exchanger 15 at a desired degree as described above. In order to increase the temperature measured by the temperature sensors 21, 22 and 23 between the second indoor heat exchanger 14 and the first indoor heat exchanger 15, the opening degrees of the outdoor adiabatic expansion valves 6*a* and/or 6*b* and/or the indoor adiabatic expansion valves 16*a* and/or 16*b* are decreased. In order to decrease the temperature measured by the temperature sensors 21, 22 and 23 between the second indoor heat exchanger 14 and the first indoor heat exchanger 15, the opening degrees of the outdoor adiabatic expansion valves 6*a* and/or 6*b* and/or the indoor adiabatic expansion valves 16*a* and/or 16*b*** are increased.

Figure 6:
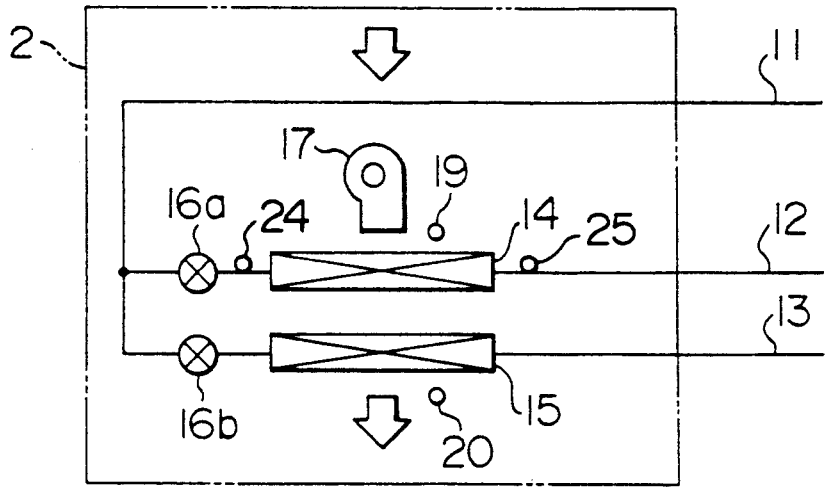
FIG. 6 is a schematic view showing another arrangement of temperature measuring devices according to the present invention.

In an embodiment shown in FIG. 6, a control according to the measured temperatures by the temperature sensors 19 and 20 is substantially equal to the control used in the embodiment shown in FIG. 3, a temperature sensor 24 measures a temperature of the refrigerant between the indoor adiabatic expansion valve **16*a* and the second indoor heat exchanger 14 and a temperature sensor 25 measures a temperature of the refrigerant which has passed through the second indoor heat exchanger 14. When the temperature measured by the temperature sensor 24 is not lower than the temperature measured by the temperature sensor 25 by a predetermined degree, that is, the temperature of the refrigerant is not increased sufficiently by the air in the room to be air-conditioned through the second indoor heat exchanger 14, the opening degrees of the outdoor adiabatic expansion valves 6*a* and/or 6*b* and/or the indoor adiabatic expansion valves 16a and/or 16b are decreased so that the flow rate of the refrigerant flowing into the second indoor heat exchanger 14** is decreased.

Figure 7:
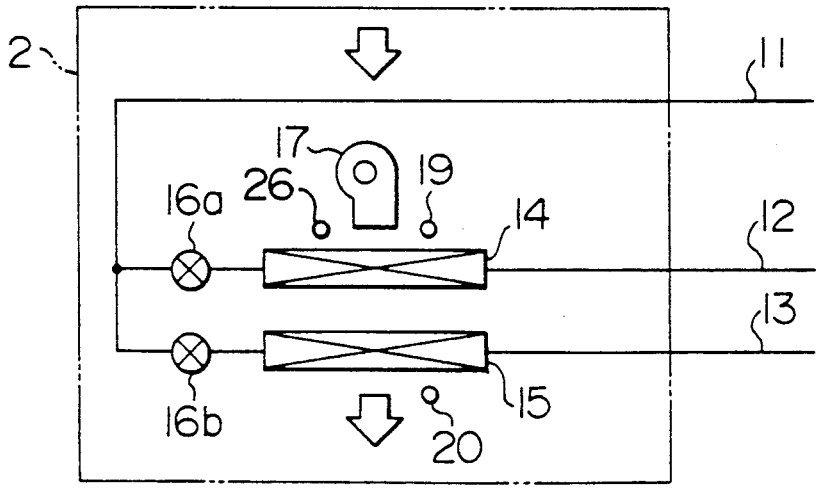
FIG. 7 is a schematic view showing another arrangement of temperature measuring devices according to the present invention.

In an embodiment shown in FIG. 7, a humidity sensor 26 measures a humidity of the air in the room to be air-conditioned at the upstream side of the second indoor heat exchanger 14. The humidity sensor 26 may be arranged between the second indoor heat exchanger 14 and the first indoor heat exchanger 15 or at the down stream side of the first indoor heat exchanger 15 or any place in the room to be air-conditioned. When the humidity measured by the humidity sensor 26 is lower than a predetermined degree, the opening degrees of the outdoor adiabatic expansion valves 6a and/or 6b and/or the indoor adiabatic expansion valves 16a and/or 16b are decreased so that the flow rate of the refrigerant flowing into the second indoor heat exchanger 14 is decreased and the heat exchanging surface temperature of the second indoor heat exchanger 14 is increased to prevent a water vapor in the air from being liquefied. When the humidity measured by the humidity sensor 26 is higher than the predetermined degree, the opening degrees of the outdoor adiabatic expansion valves 6a and/or 6b and/or the indoor adiabatic expansion valves 16a and/or 16b are increased so that the flow rate of the refrigerant flowing into the second indoor heat exchanger 14 is increased and the heat exchanging surface temperature of the second indoor heat exchanger 14 is decreased to accelerate liquefier of the water vapor in the air.

Figure 8:
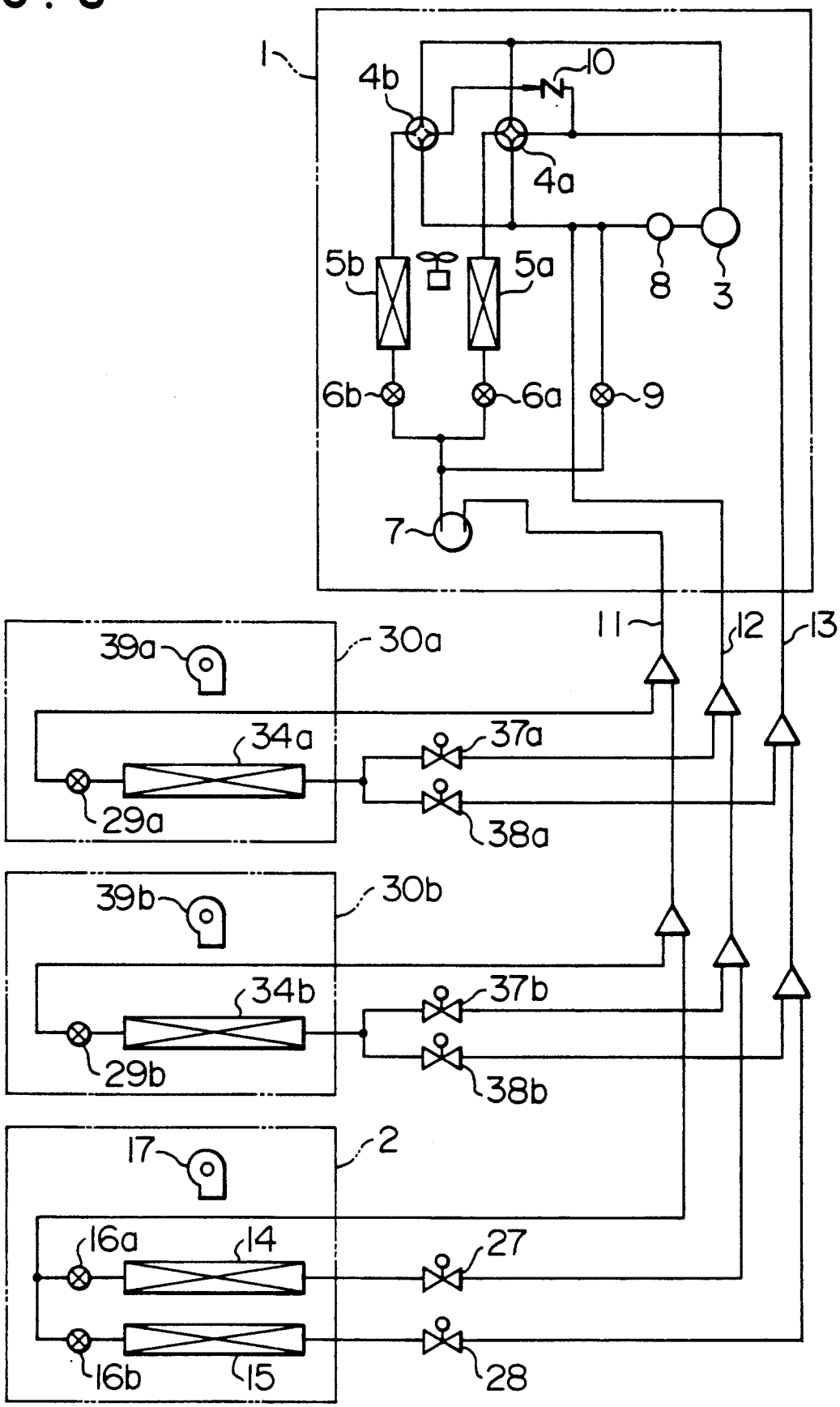
FIG. 8 is a schematic view showing another embodiment of an air-conditioning system according to the present invention.

As shown in FIG. 8, indoor units 30a and 30b, cooling operation on-off valves 27, 37a and 37b, and heating operation on-off valves 28, 38a and 38b are added to the embodiment shown in FIG. 1. In the indoor unit 2, the second indoor heat exchanger 14 is fluidly connected to the low-pressure gas refrigerant pipe 12 through the cooling operation on-off valve 27, and the first indoor heat exchanger 15 is fluidly connected to the high-pressure gas refrigerant pipe 13 through the heating operation on-off valve 28. In the indoor units 30a and 30b, air flow generating devices 39a and 39b, third indoor heat exchangers 34a and 34b, and adiabatic expansion valves 29a and 29b are arranged, respectively. The third indoor heat exchangers 34a and 34b are fluidly connected to the liquid refrigerant pipe 11 through the adiabatic expansion valves 29a and 29b respectively, are fluidly connected to the low-pressure gas refrigerant pipe 12 through the cooling operation on-off valves 37a and 37b respectively and are fluidly connected to the high-pressure gas refrigerant pipe 13 through the heating operation on-off valves 38a and 38b respectively.

When the indoor unit 30a cools the air in the room to be air-conditioned, the cooling operation on-off valve 37a is opened and the heating operation on-off valve 38a is closed in the indoor unit 30a. The high-pressure and high-temperature refrigerant flows from the outlet port of the compressor 3 through the four port connection valve 4b positioned at the second position thereof, the outdoor heat exchanger 5b for cooling and condensing the position thereof, the outdoor heat exchanger 5b for cooling and condensing the refrigerant, the outdoor adiabatic valve 6b for controlling the flow rate of the refrigerant, the liquid refrigerant receiver 7, the liquid refrigerant pipe 11 and the adiabatic expansion valve 29a for the adiabatic expansion of the refrigerant to the third indoor heat exchanger 34a through which the refrigerant cooled and subsequently expanded adiabatically after compressed flows to cools and dehumidifies the air flow generated by the air flow generating device 39a. The refrigerant flowing out from the third indoor heat exchanger 34a flows into the inlet port of the compressor 3 through the cooling operation on-off valve 38a, the low-pressure gas refrigerant pipe 12 and the accumulator 8.

When the indoor unit 30b heats the air in the room, the cooling operation on-off valve 37b is closed and the heating operation on-off valve 38b is opened in the indoor unit 30b. The high-pressure and high-temperature refrigerant flows from the outlet port of the compressor 3 through the four port connection valve 4a positioned at the first position thereof, the high-pressure gas refrigerant pipe 13 and the heating operation on-off valve 38b to the third indoor heat exchanger 34b through while the high-temperature refrigerant without being cooled and subsequently expanded adiabatically after being compressed flows to heats the air flow generated by the air flow generating device 39b. The refrigerant flowing out from the third indoor heat exchanger 34b during the heating operation flows into the second indoor heat exchanger 14 during the cooling operation and the third indoor heat exchanger 34b during the cooling operation through the adiabatic expansion valve 29b for controlling the flow rate of the refrigerant from the third indoor heat exchanger 34b, the liquid refrigerant pipe 11, the adiabatic expansion valve 29a for the adiabatic expansion and the indoor adiabatic expansion valve 16a.

When the indoor unit 2 cools and heats the air in the room for the dehumidification, the cooling operation on-off valve 27 is opened, the heating operation on-off valve 28 is opened and the unit 2 shown in FIG. 8 is controlled as the embodiment shown in FIG. 1. When the cooling operation on-off valve 27 is opened and the heating operation on-off valve 28 is closed and/or the indoor adiabatic expansion valve 16b is closed, the refrigerant cannot low through the first indoor heat exchanger 15 and the second indoor heat exchanger 14 cools the air. When the cooling operation on-off valve 27 is closed and the heating operation on-off valve 28 is opened and/or the indoor adiabatic expansion valve 16a is closed, the refrigerant cannot flow through the second indoor heat exchanger 14 and the first indoor heat exchanger 15 heats the air. When the indoor adiabatic expansion valve 16b is closed, the heating operation on-off valve 28 may be opened. When the indoor adiabatic expansion valve 16a is closed, the cooling operation on-off valve 27 may be opened.

Figure 9:
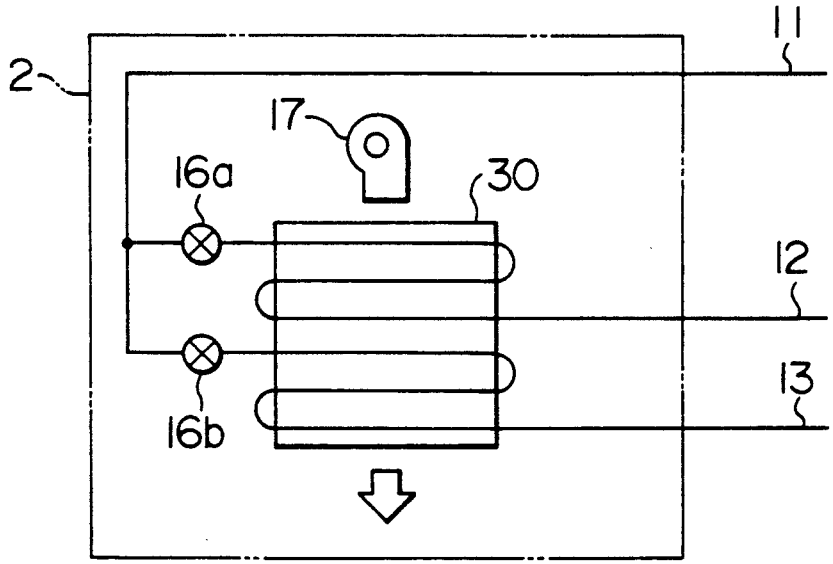
FIG. 9 is a schematic view showing another embodiment of an air-conditioning indoor unit according to the present invention.

As shown in FIG. 9, the first indoor heat exchanger 15 and the second indoor heat exchanger 14 may be included in an integral heat exchanger 30.

What is claimed is:

1. An air-conditioning system for a cooling operation and a heating operation comprising, a first heat exchanger to which a high-pressure and high-temperature refrigerant which has not been substantially cooled and adiabatically expanded after being compressed is supplied to heat an inside of a room to be air-conditioned, a second heat exchanger to which a low-pressure and low-temperature refrigerant which has been substantially cooled and adiabatically expanded after being compressed is supplied to cool the inside of the room, an air flow generator for generating an air flow which passes the first heat exchanger and the second heat exchanger, a first temperature sensor for measuring a temperature of the inside of the room, a second temperature sensor for measuring a temperature of the air flow which has passed the first and second heat exchangers, and a temperature adjusting means for determining a desired temperature of the air flow which has passed the first and second heat exchangers on the basis of a difference between a predetermined temperature and the temperature of the inside of the room measured by the first temperature sensor, and for controlling a ratio of a flow rate of the refrigerant flowing through the first heat exchanger to a flow rate of the refrigerant flowing through the second heat exchanger to change the temperature measured by the second temperature sensor to the desired temperature.

2. An air-conditioning system according to claim 1, wherein the temperature measured by the second temperature sensor ius made higher than the predetermined temperature when the temperature measured by the first temperature sensor is lower than the predetermined temperature.

3. An air-conditioning system according to claim 1, wherein the temperature measured by the second temperature sensor is made substantially equal to the predetermined temperature when the temperature measured by the first temperature sensor is substantially equal to the predetermined temperature.

4. An air-conditioning system according to claim 1, wherein the temperature measured by the second temperature sensor is made lower than the predetermined temperature when the temperature measured by the first temperature sensor is higher than the predetermined temperature.

5. An air-conditioning system according to claim 1, wherein the predetermined temperature is a desired temperature of the inside of the room.

6. An air-conditioning system according to claim 1, wherein the air flow generated by the air flow generator passes the first heat exchanger after passing the second heat exchanger.

7. An air-conditioning system according to claim 1, wherein the second heat exchanger is arranged at an upstream side of the first heat exchanger in the air flow.

8. An air-conditioning system according to claim 1, wherein the system further comprises a third heat exchanger for cooling the refrigerant after being compressed and an adiabatic expansion orifice at which the refrigerant after being compressed and cooled expands adiabatically and from which the low-pressure and low-temperature refrigerant which has been substantially cooled and adiabatically expanded after being compressed is supplied to the second heat exchanger, the temperature adjusting means controls the flow rate of the refrigerant flowing through the first heat exchanger, and the refrigerant flowing from the first heat exchanger and from the third heat exchanger flows into the second heat exchanger through the adiabatic expansion orifice.

9. An air-conditioning system according to claim 1, wherein the system further comprises a third heat exchanger for cooling the refrigerant after being compressed and an adiabatic expansion orifice at which the refrigerant after being compressed and cooled expands adiabatically and from which the low-pressure and low-temperature refrigerant which has been substantially cooled and adiabatically expanded after being compressed is supplied to the second heat exchanger, the refrigerant flowing from both of the first heat exchanger and the third heat exchanger flows into the second heat exchanger through the adiabatic expansion orifice, and the temperature adjusting means controls the flow rate of the refrigerant flowing through the second heat exchanger.

10. An air-conditioning system according to claim 1, wherein the system further comprises a third heat exchanger for cooling the refrigerant after being compressed and an adiabatic expansion orifice at which the refrigerant after being compressed and cooled expands adiabatically and from which the low-pressure and low-temperature refrigerant which has been substantially cooled and adiabatically expanded after being compressed is supplied to the second heat exchanger, the temperature adjusting means controls the flow rate of the refrigerant flowing from the third heat exchanger to the second heat exchanger, and the refrigerant flowing from the first heat exchanger and from the third heat exchanger flows into the second heat exchanger through the adiabatic expansion orifice.

11. An air-conditioning system according to claim 1, wherein the refrigerant cooled in the first heat exchanger is supplied to the second heat exchanger after an adiabatic expansion thereof.

12. An air-conditioning system according to claim 11, wherein the refrigerant cooled in the first heat exchanger is further cooled by the refrigerant flowing out from the second heat exchanger, before the adiabatic expansion thereof.

13. An air-conditioning system according to claim 1, wherein the first temperature sensor is arranged at an upstream side of the second heat exchanger in the air flow.

14. An air-conditioning system according to claim 1, wherein the temperature adjusting means is controlled to increase the flow rate of the refrigerant flowing through the first heat exchanger in relation to the flow rate of the refrigerant flowing through the second heat exchanger when the temperature measured by the first temperature sensor is lower than the predetermined temperature, and the temperature adjusting means is controlled to decrease the flow rate of the refrigerant flowing through the first heat exchanger in relation to the flow rate of the refrigerant flowing through the second heat exchanger when the temperature measured by the first temperature sensor is higher than the predetermined temperature.

15. An air-conditioning system according to claim 1, wherein the temperature adjusting means is controlled to decrease the flow rate of the refrigerant flowing through the second heat exchanger in relation to the flow rate of the refrigerant flowing through the first heat exchanger when the temperature measured by the first temperature sensor is lower than the predetermined temperature, and the temperature adjusting means is controlled to increase the flow rate of the refrigerant flowing through the second heat exchanger in relation to the flow rate of the refrigerant flowing through the first heat exchanger when the temperature measured by the first temperature sensor is higher than the predetermined temperature.

16. An air-conditioning system according to claim 1, wherein the system further comprises a humidity sensor for measuring a humidity in the inside of the room, the temperature adjusting means is controlled in accordance with a difference between the humidity measured by the humidity sensor and a predetermined humidity so that the difference is decreased.

17. An air-conditioning system according to claim 16, wherein the temperature adjusting means is controlled to decrease the flow rate of the refrigerant flowing through the second heat exchanger when the humidity measured by the humidity sensor is lower than the predetermined humidity, and the temperature adjusting means is controlled to increase the flow rate of the refrigerant flowing through the second heat exchanger when the humidity measured by the humidity sensor is higher than the predetermined humidity.

18. An air-conditioning system according to claim 1, wherein the second temperature sensor is arranged at a downstream side of the first heat exchanger in the air flow.

19. An air-conditioning system according to claim 1, wherein the temperature adjusting means is controlled to increase the flow rate of the refrigerant flowing through the first heat exchanger in relation to the flow rate of the refrigerant flowing through the second heat exchanger when the temperature measured by the second temperature sensor is lower than the predetermined temperature, and the temperature adjusting means is controlled to decrease the flow rate of the refrigerant flowing through the first heat exchanger in relation to the flow rate of the refrigerant flowing through the second heat exchanger when the temperature measured by the second temperature sensor is higher than the predetermined temperature.

20. An air-conditioning system according to claim 1, wherein the temperature adjusting means is controlled to decrease the flow rate of the refrigerant flowing through the second heat exchanger in relation to the flow rate of the refrigerant flowing through the first heat exchanger when the temperature measured by the second temperature sensor is lower than the predetermined temperature, and the temperature adjusting means is controlled to increase the flow rate of the refrigerant flowing through the second heat exchanger in relation to the flow rate of the refrigerant flowing through the first heat exchanger when the temperature measured by the second temperature sensor is higher than the predetermined temperature.

21. An air-conditioning system according to claim 1, wherein the system further comprises a third temperature sensor for measuring a temperature of the air flow between the first heat exchanger and the second heat exchanger, the temperature adjusting means is controlled in accordance with a difference between the temperature measured by the third temperature sensor and a predetermined temperature so that the difference is decreased.

22. An air-conditioning system according to claim 21, wherein the system further comprises a fourth temperature sensor for measuring a temperature of the refrigerant which has not been substantially heated in the second heat exchanger and a fifth temperature sensor for measuring a temperature of the refrigerant which has been substantially heated in the second heat exchanger, the temperature adjusting means is controlled to decrease the flow rate of the refrigerant flowing through the second heat exchanger when a difference between the temperature measured by the fourth temperature sensor and the temperature measured by the fifth temperature sensor is smaller than a predetermined degree.

23. An air-conditioning system according to claim 1, wherein the second heat exchanger and the first heat exchanger are integrally connected to each other.

* * * * *